US005913951A

United States Patent [19]

Herr et al.

[11] Patent Number: 5,913,951

[45] Date of Patent: Jun. 22, 1999

[54] RADIALLY ORIENTED MOTOR FOR A FLUID BALANCE RING

[75] Inventors: Joel L. Herr; Troy A. Johnson; John E. Thomas, all of Newton, Iowa

[73] Assignee: Maytag Corporation, Newton, Iowa

[21] Appl. No.: 08/992,587

[22] Filed: Dec. 17, 1997

[51] Int. Cl.[6] ..... D06F 37/22

[52] U.S. Cl. ..... 8/158; 68/23.2; 74/573 F

[58] Field of Search ..... 8/158; 68/12.06, 68/23.2; 74/573 F; 210/144, 363, 364

[56] References Cited

U.S. PATENT DOCUMENTS

| | | | |
|---|---|---|---|
| Re. 23,481 | 5/1952 | Castner et al. . | |
| 2,341,695 | 5/1944 | Critchfield . | |
| 2,534,269 | 12/1950 | Kahn et al. . | |
| 2,695,104 | 11/1954 | Remer . | |
| 3,117,926 | 1/1964 | Starr et al. | 68/12.06 X |
| 3,610,069 | 10/1971 | Tanner | 74/573 F X |
| 3,812,724 | 5/1974 | Curtz et al. | 74/573 F X |
| 4,002,086 | 1/1977 | Reinhall | 74/573 F |
| 4,991,247 | 2/1991 | Castwell et al. | 210/144 X |
| 5,156,067 | 10/1992 | Umeyama | 74/573 F |
| 5,490,436 | 2/1996 | Coyne et al. | 74/573 F |

*Primary Examiner*—Philip R. Coe

*Attorney, Agent, or Firm*—Zarley, McKee, Thomte, Voorhees & Sease

[57] ABSTRACT

A radially mounted motor is provided in a closed system fluid balance ring for high rotational speed washing machines. The motor is mounted at an orientation of 90° relative to the rotational axis of the washing machine spinner. Such an orientation prevents adverse effects on the motor contacts from centrifugal forces generated by the rotating spinner. A 90° orientation also eliminates deflection of the motor shaft and excessive friction on the motor bearings. The angular orientation of the motor assures proper functioning of the closed system fluid balance ring of the washing machine. The balance system also includes a valve to control movement of fluid within the ring. The valve is mounted at an angle with respect to a tangent of the spinner so as to prevent detrimental effects from the centrifugal forces of the rotating spinner.

19 Claims, 3 Drawing Sheets

Fs
Fm
Fc
A
10
12
14
16
18
20
22
24
26
28
30
32
34
56

10
12
16
18
20
22
24
26
28
30
32
34
56
58
60
62
64

RADIALLY ORIENTED MOTOR FOR A FLUID BALANCE RING

BACKGROUND OF THE INVENTION

In conventional clothes washing machines, either front loading or top loading, the spinner is rotatably mounted within the cabinet with top rotational speeds of approximately 600 rpm. Typically, a balancing system is provided in the machine so as to counteract uneven or unbalanced loads in the spinner during the spin cycle. One type of balancing system is a closed system, wherein a fluid ring having multiple chambers or compartments is mounted to the spinner. A motor in the balance ring activates a pump which transfers a liquid from one chamber to another in response to unbalanced loads, with a solenoid valve being used to refine the transfer, thereby automatically balancing the spinner during the spin cycle. A solenoid valve is placed in line with the pump to turn the water flow off and on. Sensors, normally positioned remote from the balance ring, determine the unbalanced condition of the spinner, and calculate the movement of the fluid from one chamber to another. An alternative balancing system is an open system, wherein a liquid, such as water, is injected into chambers in a ring mounted on the spinner. In such an open system, clogging of the water injector may be a problem. The closed system has a clean controlled fluid supply, thereby avoiding the problem of the open balancing system.

In Europe, horizontal axis washing machines operate at speeds up to 1600 rpm. These European machines do not use a fluid balance ring with a motor and pump.

It is desirable to use closed system fluid balance rings with machines having rotational speeds up to 1600 rpm. Such high spin rates create substantial centrifugal acceleration of up to 300 times the force of gravity, depending on the diameter of the spinner. These high centrifugal forces create problems with the operation of the balance system motor, which is normally mounted so as to be parallel to the axis of rotation of the spinner in prior art machines. One problem of such a conventionally mounted motor in the new high speed washing machines is that the centrifugal forces pull the electrical brush contacts away from the commutator thereby severing electrical contact. For example, the centrifugal force at high rpm overcomes the spring force of the spring biased arms upon which the contacts are mounted, thereby interrupting the electrical current by preventing closure of the arms and contacts, which thus decreases the efficiency and life of the motor. Generally, two factors account for opening of the contacts when the motor is energized to activate the pumps: the spring force of the spring biased arms and the centrifugal force generated by the rotating spinner. It is desirable that the centrifugal force does not overcome the spring force.

The high rpm also effects the spring biased armature of the solenoid valve, which moves up and down in response to electrical current. As with the motor brush arms, the centrifugal force at high rpm's overcomes the spring bias of the valve armature, thereby preventing closure of the armature when the current stops, and thus preventing closure of the valve.

Accordingly, a primary objective of the present invention is the provision of an improved fluid balance ring system for a high speed clothes washing machine.

Another objective of the present invention is the provision of a closed system fluid balance ring for a clothes washing machine wherein the motor of the system is oriented at an angle relative to the rotational axis of the spinner, such that the centrifugal force generated by the rotating spinner does not overcome the operation of the motor.

Another objective of the present invention is the provision of a closed fluid balance ring system for a washing machine wherein the solenoid valve is mounted so as to prevent centrifugal forces from detrimentally effecting the function of the valve.

A further objective of the present invention is the provision of a method of balancing an uneven load in a high speed rotating spinner wherein the centrifugal forces of rotation are prevented from overcoming the motor and valve operation.

Still another objective of the present invention is the provision of wherein the motor of a fluid balance ring is mounted at an angle with respect to the axis of rotation of the washing machine spinner.

Still another objective of the present invention is the provision of wherein the valve of a fluid balance ring is mounted at an angle with respect to the axis of rotation of the washing machine spinner.

These and other objectives will become apparent from the following description of the invention.

SUMMARY OF THE INVENTION

The present invention is directed towards a radially mounted motor and valve for a closed system fluid balance ring for a high speed laundry appliance, such as a washing machine. The washing machine includes a spinner which is rotatable at speeds up to 1600 rpm. Remote sensors sense an uneven load in the rotating spinner, and in response thereto, energizing a motor which activates a pump to direct fluid between compartments in the ring, with a solenoid valve placed in series to refine the transfer of fluid, thereby counter-balancing the uneven load. The motor is oriented so as to be at an angle with respect to the rotation axis of the spinner, thereby preventing or minimizing the effects of centrifugal force from the rotating spinner upon the operation of the motor. More particularly, the angular orientation of the motor with respect to the rotational axis prevents the rotation centrifugal force from overcoming the spring bias of the motor electrical contacts and reducing the deflection of the motor shaft. Orienting the motor at 90° to the rotational axis of the spinner also prevents deflection of the motor shaft and excessive friction on the sliding bearings. The valve of the balancing system is also mounted at an angle relative to tangency of the spinner, such that the centrifugal force of the rotating spinner does not dominate the movement of the valve armature. More particularly, the angular orientation of the valve with respect to the tangency of the spinner prevents centrifugal force from overcoming the spring bias on the armature and the electrical magnetic forces of the coils.

DETAILED DESCRIPTION OF THE DRAWINGS

Figures 1, 8:
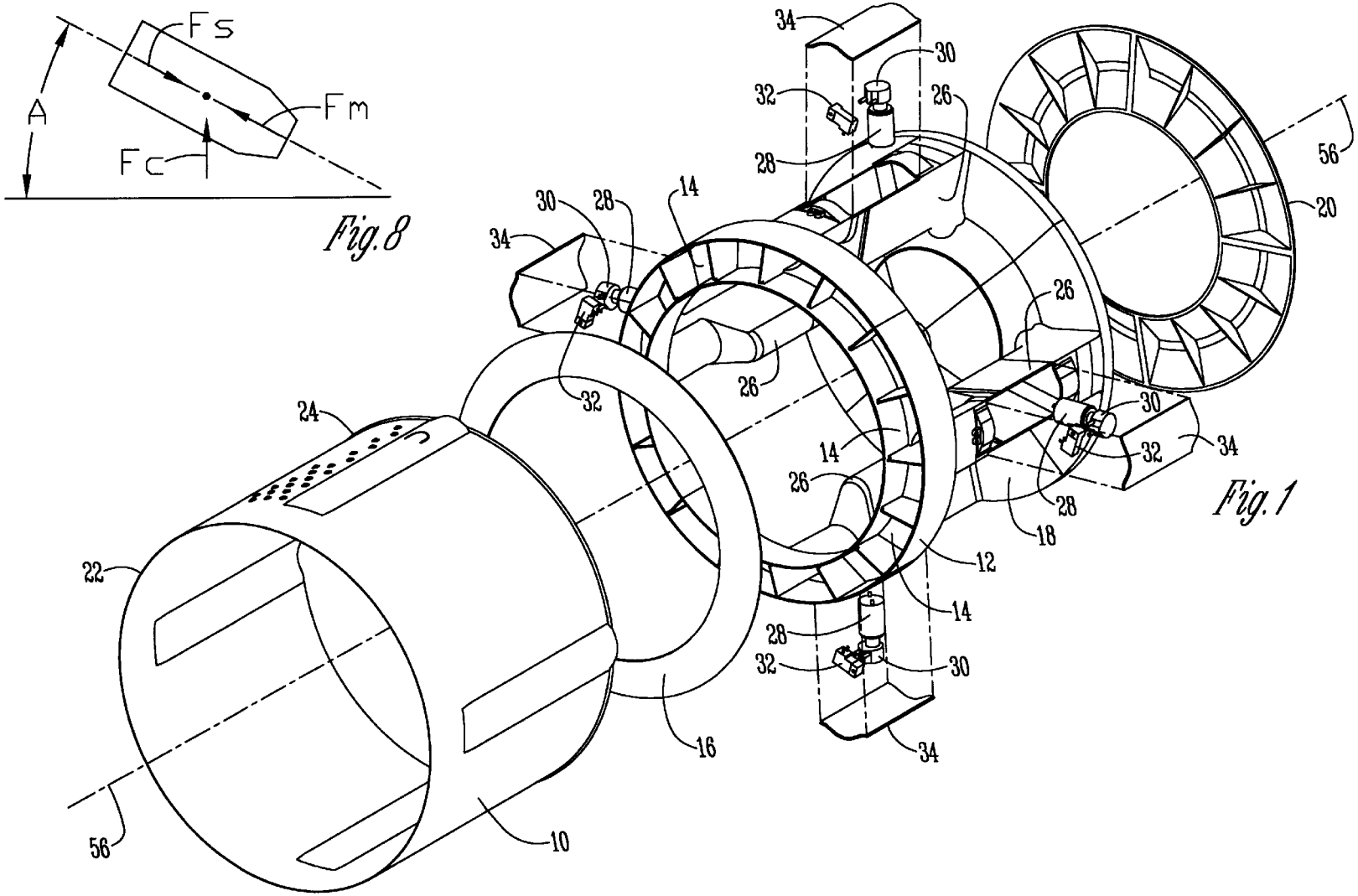
FIG. 1 is a front isometric exploded view of the washing machine spinner and fluid balance ring assembly.
FIG. 8 is a schematic illustration of the forces acting on the valve.
Figures 2, 6:
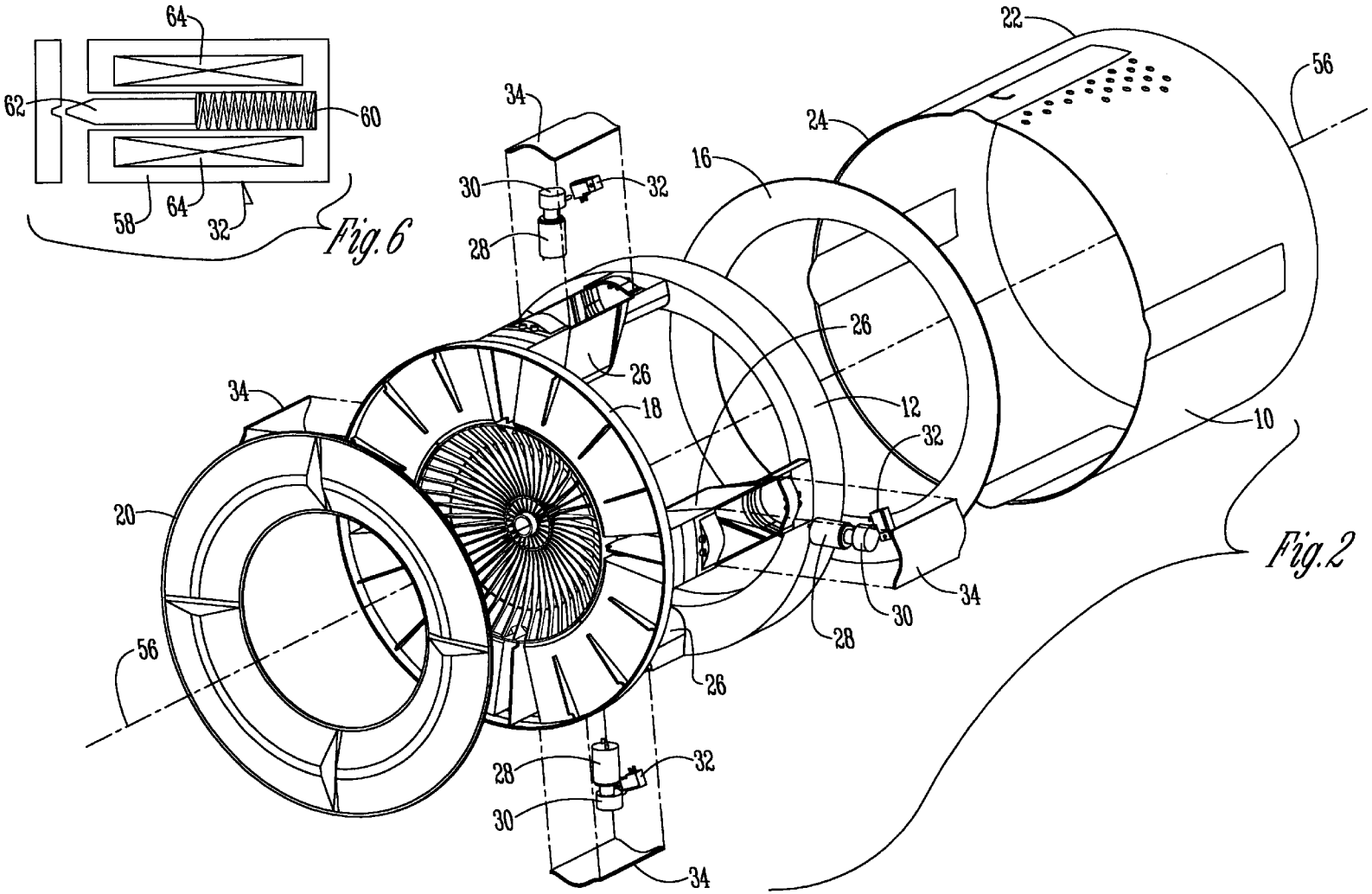
FIG. 2 is a rear isometric exploded view of the spinner and fluid balance ring assembly.
FIG. 6 is a schematic view of the valve.

A horizontal axis clothes washing machine includes a spinner 10 rotatably mounted within a cabinet. In the present invention, the structure of the cabinet and drive train are conventional, and therefore are not shown in the drawings. FIGS. 1 and 2 illustrate the basic construction of the spinner with a closed system fluid balance ring.

More particularly, the spinner includes a fluid balance ring assembly. The assembly includes a front ring 12 having a plurality of compartments 14 therein which are closed by a cover 16. A similar back ring 18 has a plurality of compartments which are closed by a back cover 20. The front ring 12 is positioned adjacent the open front end 22 of the spinner 10, while the back ring 18 is positioned adjacent the back end 24 of the spinner 10.

A plurality of baffles 26 extend between the front ring 12 and the back ring 18 on the inner surface of the side wall 10. The baffles 26 function to lift and tumble clothing within the spinner during the wash cycle of the machine. The baffles 26 also define a housing for the motor 28, pump 30 and solenoid valve 32 which control the transfer of fluid within the compartments of the rings 12 and 18. A cover 34 is provided for each baffle 26 so as to seal the baffle housing against water leakage.

The basic structure of the fluid rings 12, 18, covers 16, 20, baffles 26, and baffle covers 34 is conventional. The motors 28, pumps 30, and solenoid valves 32 are also conventional, along with their electrical and fluid connections.

Figure 4:
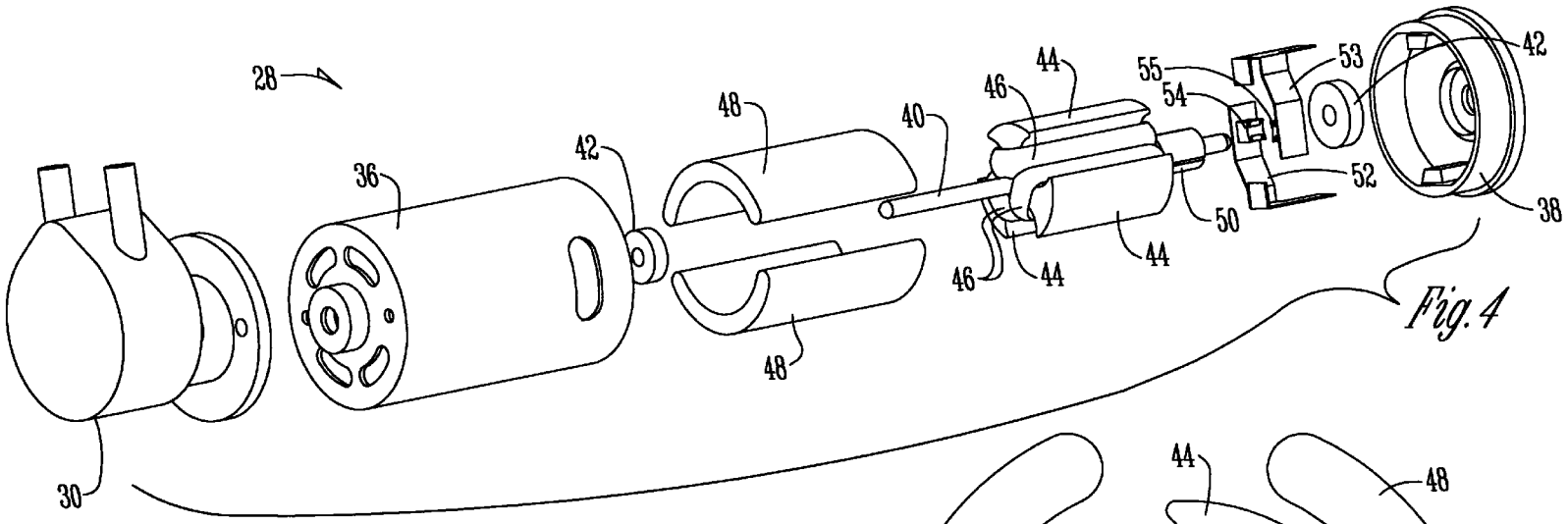
FIG. 4 is an exploded view of the pump and motor.
Figure 5:
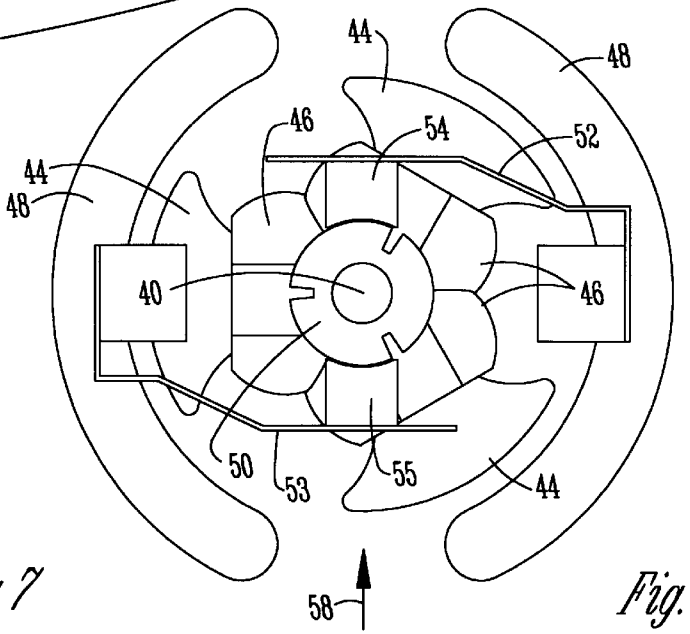
FIG. 5 is an end view of the motor, with the bottom cap and housing removed.

As best seen in FIG. 4, each motor includes a housing 36 and an end cap 38. A shaft 40 is journaled within the housing 36 and end cap 38 and rotationally supported by bearings or bushings 42. Mounted on the shaft 40 is a laminated stack 44 with electrical coils or windings 46 wound around the stack and the commutator. A pair of permanent magnets 48 extend substantially around the stack 44 within the housing 36. A commutator 50 is provided on one end of the shaft 40. A pair of spring biased arms 52, 53 each have an electrical contact 54, 55 mounted thereon which are adapted to normally contact the commutator 50, as shown in FIG. 5. Power is supplied to the motor through electrical contacts 54, 55. The arms 52, 53 spring load the electrical contacts 54, 55 against the commutator 50. This supplies current to the coils 46 which generates the torque to rotate the shaft 40.

FIG. 6 shows the valve 32, which includes a housing 58, with a spring 60 holding the armature 62 in the closed position and a coil 64 which when energized overcomes the spring force and opens the valve 32.

The present invention is directed towards the mounting orientation of the motors 28 and valves 32 with respect to the centrifugal forces generated by the rotating spinner 10. More specifically, the motors 28 are mounted within the baffles 26 such that the motor shafts 40 are oriented at an angle with respect to the rotational axis 56 of the spinner 10.

Figure 7:
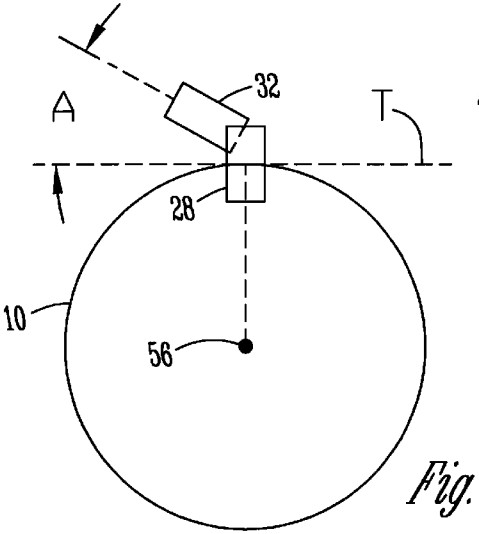
FIG. 7 is a schematic view showing the orientation of the motor and valve.
Figure 3:
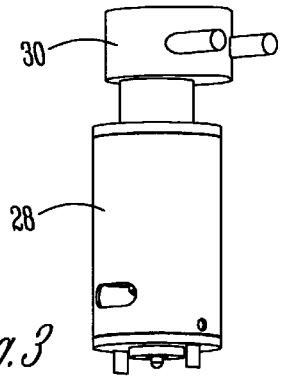
FIG. 3 is an isometric view of the pump and motor of the fluid balance ring.

In a most preferred embodiment, as shown in FIG. 7, each motor 28 is oriented such that the shaft 40 is substantially perpendicular to the rotational axis 56 of the spinner 10. With such an orientation, the centrifugal force generated by the spinner rotating at speeds up to 1600 rpm will not overcome the force of the spring arms 52 since the centrifugal force is vectorially at 90° relative to the spring force of the spring arms 52. In such a 90° orientation, the high centrifugal forces will not deflect the shaft 40, which would lead to unequal gaps or spaces between the stacks 44 and the magnets 48, which leads to reduced efficiency of the motor 28. Also, excessive shaft deflections arising from centrifugal forces which are not parallel to the motor shaft 40 may cause the stacks 44 to engage or strike the magnets 48. Accordingly, each motor 28 will function properly, despite the high centrifugal forces of the rotating spinner.

The 90° orientation of the motor 28 relative to the rotational axis 56 also minimizes friction on the sliding bearings 42. When the centrifugal force is not parallel to the shaft 40, excessive friction on the bearings 42 produces less efficient operation of the motor 28.

If the motor 28 is mounted parallel to the rotational axis 56, the centrifugal forces shown as vector 58 in FIG. 5 generated at high rotational speeds will overcome the spring force of spring arm 52, thereby pulling the contact 54 out of engagement with the commutator 50. On the opposite side of the commutator 50, the brush or contact 55 on the spring arm 53 is forced against the commutator 50, thereby causing greater friction and wear on the contact 55.

The valves 32 are also oriented so as to prevent centrifugal forces from dominating the movement of the valve armature and thereby disabling the valve operation. As seen in FIG. 7, each valve 32 is preferably mounted at an angle A with respect to the tangent T to the spinner 10. The angle A depends upon the spring force of the armature.

The angle A must be sufficient such that $$F_s > F_c * \sin A + \mu * F_c * \cos A$$

so as to close the valve, and such that $$F_m > -F_c * \cos A + F_c * \cos A * \mu$$

so as to open the valve, wherein $F_s$=spring force $F_c$=centrifugal force $F_m$=magnetic force $\mu$=coefficient of friction These forces are shown in the schematic drawing of FIG. 8.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An improved fluid balance ring for a laundry appliance having a spinner mounted for rotation about an axis, the ring including a motor with a shaft and a pump operatively connected to the motor for transferring fluid within the ring to balance an uneven load in the spinner, the improvement comprising:

the motor shaft being angularly oriented with respect to an axis of rotation of the spinner.

2. The improved fluid balance ring of claim 1 wherein the angle of the motor shaft relative to the spinner rotational axis is approximately 90°.

3. The improved fluid balance ring of claim 1 wherein the rotating spinner generates centrifugal forces, and the motor includes spring biased electrical contact brushes, the angle of the motor shaft relative to the spinner axis of rotation being sufficient such that centrifugal forces do not overcome the spring bias of the contact brushes.

4. The improved fluid balance ring of claim 1 wherein the rotating spinner generates centrifugal forces, the angle of the motor shaft relative to the spinner axis of the rotation being sufficient such that the shaft is substantially free from deflection caused by the centrifugal forces.

5. The improved fluid balance ring of claim 1 further comprising a valve oriented such that centrifugal forces generated by the rotating spinner do not detrimentally effect operation of the valve.

6. The improved fluid balance ring of claim 5 wherein the valve has a spring force and a magnetic force acting thereon, and is oriented at an angle such that the spring force and magnetic force are greater than counter-acting forces.

7. A method of balancing an uneven load in a rotating spinner, comprising:

transferring fluid in a fluid balance ring when the load in the spinner becomes uneven by pumping fluid with a pump and motor assembly mounted on the spinner;

preventing centrifugal forces generated by the rotating spinner from overcoming the operation of the motor and pump assembly by orienting the motor at an angle relative to the axis of the rotation of the spinner.

8. The method of claim 7 wherein the orientation of the motor is approximately 90° relative to the axis of rotation of the spinner.

9. The method of claim 7 wherein a valve is operatively connected to the pump to control transfer of fluid in the fluid balance ring, the method further comprising preventing centrifugal forces generated by the rotating spinner from overcoming the operation of the valve by orienting the valve at an angle relative to a tangent of the spinner.

10. The method of claim 9 wherein the angle of the valve is sufficient such that spring and magnetic forces of the valve are greater than counter-acting forces.

11. A washing machine comprising:

a cabinet;

a spinner mounted in the cabinet for rotation about an axis;

a fluid balance ring on the spinner and having a plurality of compartments;

a motor mounted in the spinner;

a pump connected to the motor for pumping fluid between the compartments in the balance ring; and the motor having a shaft mounted at a non-parallel orientation with respect to the axis of rotation of the spinner.

12. The washing machine of claim 11 wherein the motor shaft is oriented approximately 90° with respect to the spinner axis of rotation.

13. The washing machine of claim 11 wherein the spinner rotates at speeds up to 1600 rpm.

14. The washing machine of claim 11 further comprising a solenoid valve operatively connected to the pump and being oriented at an angle such that the valve is not rendered inoperative by centrifugal forces generated by rotation of the spinner.

15. The washing machine of claim 14 wherein the valve has a spring force and a magnetic force acting thereon, and is oriented at an angle such that the spring force and magnetic force are greater than counter-acting forces.

16. The washing machine of claim 14 wherein the valve generates magnetic forces which overcome the centrifugal force generated by rotation of the spinner.

17. An improved fluid balance ring for a laundry appliance having a spinner mounted for rotation about an axis, the ring including a motor with a shaft and a pump operatively connected to the motor for transferring fluid within the ring to balance an uneven load in the spinner, the improvement comprising:

a valve operatively connected to the pump and being oriented at an angle relative to the spinner axis of rotation.

18. The improved fluid balance ring of claim 17 wherein the wherein the valve has a spring force and a magnetic force acting thereon, and is oriented at an angle such that the spring force and magnetic force are greater than counter-acting forces.

19. The improved fluid balance ring of claim 18 wherein the rotating spinner generates centrifugal forces and the operating valve contains spring forces, the valve having an armature angularly oriented relative to the tangent such that the centrifugal forces do not overcome the spring forces.

* * * * *